US009419332B2

(12) United States Patent
Nilsson

(10) Patent No.: US 9,419,332 B2
(45) **Date of Patent: *Aug. 16, 2016**

(54) HIGH GAIN WIDEBAND OMNIDIRECTIONAL ANTENNA

(71) Applicant: Consolidated Radio, Inc., North Canton, OH (US)

(72) Inventor: Jack Nilsson, Canton, OH (US)

(73) Assignee: Consolidated Radio, Inc., North Canton, OH (US)

( * ) Notice: Subject to any disclaimer, the term of this patent is extended or adjusted under 35 U.S.C. 154(b) by 255 days.

This patent is subject to a terminal disclaimer.

(21) Appl. No.: 14/163,318

(22) Filed: Jan. 24, 2014

(65) Prior Publication Data

US 2014/0203984 A1 Jul. 24, 2014

Related U.S. Application Data

(60) Provisional application No. 61/817,589, filed on Apr. 30, 2013, provisional application No. 61/756,137, filed on Jan. 24, 2013.

(51) Int. Cl.

| | |
|---|---|
| ***H01Q 13/04*** | (2006.01) |
| ***H01Q 1/42*** | (2006.01) |
| ***H01Q 9/28*** | (2006.01) |
| ***H01Q 21/08*** | (2006.01) |

(52) U.S. Cl.

CPC . *H01Q 1/42* (2013.01); *H01Q 9/28* (2013.01); *H01Q 21/08* (2013.01)

(58) Field of Classification Search

CPC ..... H01Q 13/04; H01Q 21/08; H01Q 1/42; H01Q 13/0258; H01Q 1/08

USPC ..... 343/774, 773, 808, 846

See application file for complete search history.

(56) References Cited

U.S. PATENT DOCUMENTS

| | | | | |
|---|---|---|---|---|
| 5,534,880 | A | 7/1996 | Button et al. | |
| 6,057,804 | A | 5/2000 | Kaegebein | |
| 6,154,182 | A * | 11/2000 | McLean | H01Q 9/28 343/752 |
| 6,191,751 | B1 * | 2/2001 | Johnson | H01Q 1/3291 343/713 |
| 6,593,892 | B2 | 7/2003 | Honda et al. | |
| 6,947,006 | B2 | 9/2005 | Diximus et al. | |
| 7,215,292 | B2 * | 5/2007 | McLean | H01Q 7/00 343/725 |
| 7,855,693 | B2 | 12/2010 | Martek et al. | |
| 8,228,257 | B2 | 7/2012 | Lalezari | |
| 8,730,118 | B1 * | 5/2014 | McLean | H01Q 9/28 343/773 |
| 2005/0219136 | A1 * | 10/2005 | Iskander | H01Q 13/08 343/772 |

* cited by examiner

*Primary Examiner* — Huedung Mancuso

(74) *Attorney, Agent, or Firm* — Sand & Sebolt; Howard L. Wernow

(57) ABSTRACT

The present invention relates to a series fed collinear antenna which includes cone-shaped radiating elements energized via a series fed common transmission line. Phasing stubs are provided between selected radiating elements and are oriented such that the phasing stub improves gain and reliability by affecting the signal to produce a beneficial elevational coordinate signal pattern. A ground plane may be provided proximate the lower end of the antenna structure to further enhance the radiated signal. The ground plane may be formed in the shape of a dome having an apex vertically disposed above a rim.

20 Claims, 10 Drawing Sheets

HIGH GAIN WIDEBAND OMNIDIRECTIONAL ANTENNA

CROSS-REFERENCE TO RELATED APPLICATION

This application claims priority from U.S. Provisional Application Ser. No. 61/817,589, filed Apr. 30, 2013 and from U.S. Provisional Application Ser. No. 61/756,137, filed Jan. 24, 2013; the disclosures of which are incorporated herein by reference.

BACKGROUND OF THE INVENTION

1. Technical Field

This invention relates to a device for transmitting and receiving electromagnetic waves. More particularly, this invention relates to a high gain omnidirectional antenna. Specifically, this invention relates to a series fed omnidirectional antenna formed via collinear cone elements which are phased using external elements angled with respect to the overall longitudinal axis of the antenna. Further, this invention relates to incorporating a dome shaped ground plane element into the overall series fed omnidirectional antenna design.

2. Background Information

The standard series-fed collinear high gain omnidirectional antenna design has several undesirable characteristics such as a distinctly narrowed frequency range. This narrowed frequency range applies to gain, standing wave radio (SWR), and overall pattern. The primary elevation coordinate signal pattern drops well below the horizon with frequency decreasing below the optimal tuned frequency. Conversely, corporate-fed coaxial dipoles seen for decades mounted on towers and masts, maintain the elevation coordinate signal pattern near the horizon at all tuned frequencies. While the series-fed collinear designs occupy a small horizontal space, typically contained in a vertical tube made of fiberglass, corporate fed coaxial dipoles around a mast or tower take up an enormous amount of horizontal space. This leads to problems with wind shear and elements as a fiberglass tube generally is not available for protection from the elements for such a large horizontal structure.

More recent designs have attempted to combine the smaller lateral dimension advantage of standard series-fed collinear antennas with the broader frequency range maintained near horizon of the standard horizontally spaced corporate-fed omnidirectional antennas. Inasmuch as there are increasing needs for broader frequency band antennas, there is a tremendous need in the art for antennas which have reliably broader frequency ranges.

As seen in U.S. Pat. No. 6,057,804, and in particular, FIGS. 11 and 12, one significant design issue with corporate-fed coaxial dipoles relates to incorporating the complex feed system into the overall antenna design. The disclosure of U.S. Pat. No. 6,057,804 incorporates cylindrical element dipoles of substantially larger diameter such that the corporate-fed system has room inside the center of these stacked cylindrical dipoles for encapsulating the feed system. One will readily recognize this design is inherently very complex and involves an exponentially increasing number of connections as the input signal is split for each cylindrical dipole added.

There have been attempts to recognize the broad frequency band characteristics of the cone-style element and incorporate such cone-style into a corporate fed design. As shown in U.S. Pat. No. 7,855,693, and in particular, FIGS. 1 and 2, this design does not alleviate the complexity of powering each coned element. This can be further shown in U.S. Pat. No. 5,534,880, and in particular FIG. 2.

BRIEF SUMMARY OF THE INVENTION

The present invention includes a novel approach to expanding the gain and reliability of a series fed collinear antenna. The present invention includes cone-shaped radiating elements energized via a series fed common transmission line. Phasing stubs are provided between selected radiating elements and are oriented such that the phasing stub improves gain and reliability by affecting the signal to produce a beneficial elevational coordinate signal pattern. A ground plane may be provided proximate the cone-shaped radiating elements to further enhance the radiated signal. This ground plane may be formed in a dome shape with the apex of the dome generally vertically spaced above the outer rim of the dome. This ground plane may have a surface length from the apex of the dome to the rim greater than ¼ wave, with the surface length preferably around ½ wave length or greater.

In one aspect, the invention may provide a series-fed collinear high gain omnidirectional antenna adapted to radiate electromagnetic energy at an intended frequency having a wave length, the antenna comprising: a first radiative element comprised of a first cone having a first apex and a second cone having a second apex, wherein the first apex is secured to the second apex; a second radiative element comprised of a third cone having a third apex; and a first phasing stub extending outwardly away from the second cone to a first phasing stub apex and extending inwardly from the first phasing stub apex the third cone, wherein the first phasing stub includes a first length configured synchronize radiative phase between the first radiative element and the second radiative element.

In another aspect, the invention may provide a series fed collinear antenna comprising: a first cone shaped element having a first apex and a first base and adapted to radiate electromagnetic energy; a second cone shaped element having a second apex and a second base and adapted to radiate electromagnetic energy; a phasing stub having a length and extending outwardly away from the first cone shaped element and the second cone shaped element; wherein the phasing stub electrically connects the first cone shaped element and the second cone shaped element; and wherein the length is configured synchronize radiative phase between the first cone shaped element and the second cone shaped element.

In another aspect, the invention may provide an antenna comprising: a first element having a first end and a spaced apart second end and adapted to radiate electromagnetic energy; a second element having a third end and a spaced apart fourth end and adapted to radiate electromagnetic energy; at least one phasing stub having a length and extending outwardly away from the first element to a phasing stub apex and extending inwardly to the second element from the phasing stub apex; a transmitter for supplying electrical power to one of the first element and the second element; wherein the at least one phasing stub electrically connects the first element and the second element in series; and wherein the length is configured to synchronize radiative phase between the first element and the second element.

BRIEF DESCRIPTION OF THE SEVERAL VIEWS OF THE DRAWINGS

Preferred embodiments of the invention, illustrated of the best mode in which Applicant contemplates applying the principles, are set forth in the following description and are shown in the drawings and are particularly and distinctly pointed out and set forth in the appended claims.

Similar numbers refer to similar parts throughout the drawings.

DETAILED DESCRIPTION OF THE INVENTION

Figure 1:
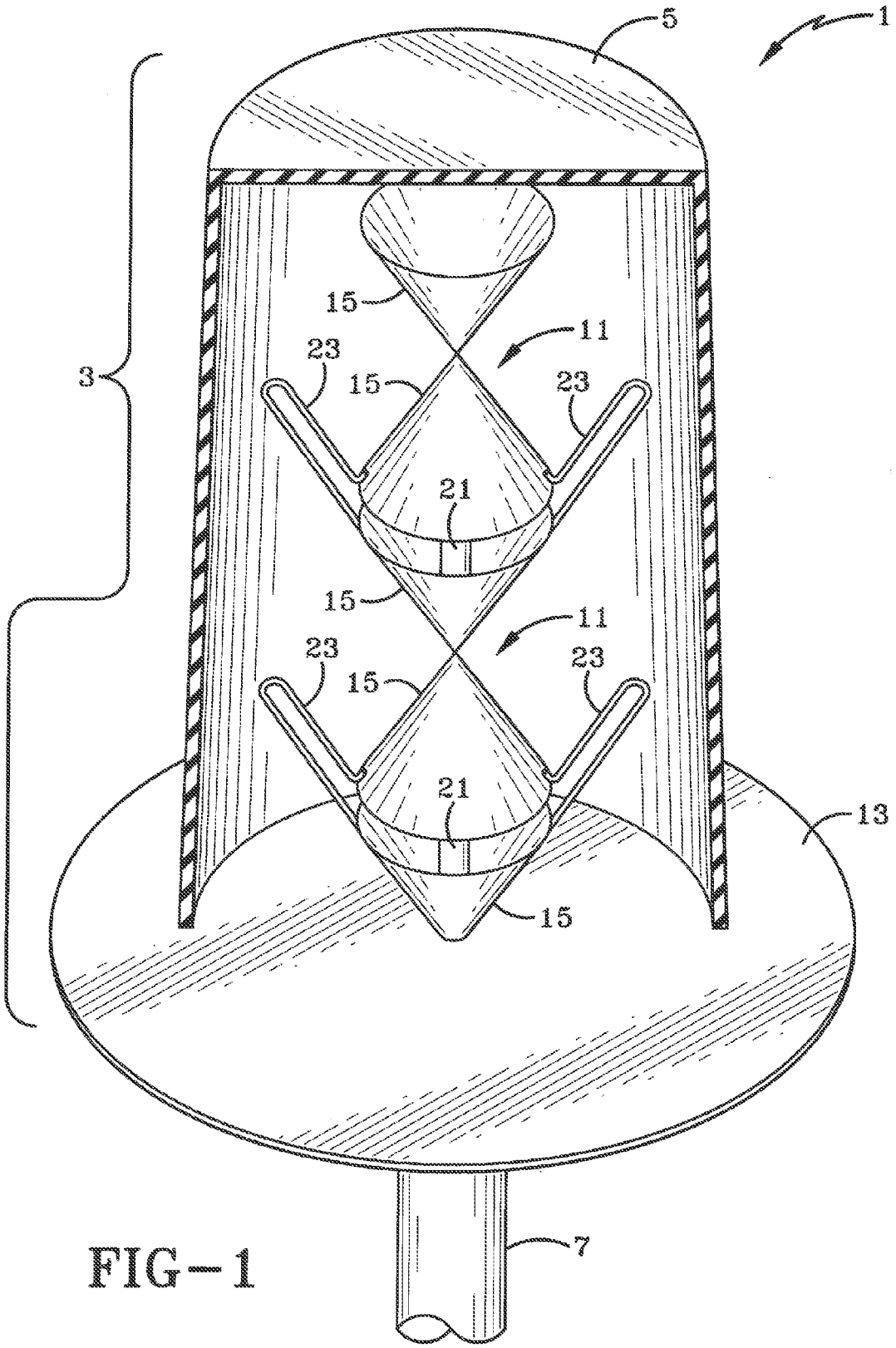
FIG. 1 is a perspective cross-sectional view of the antenna of the present invention.
Figure 2:
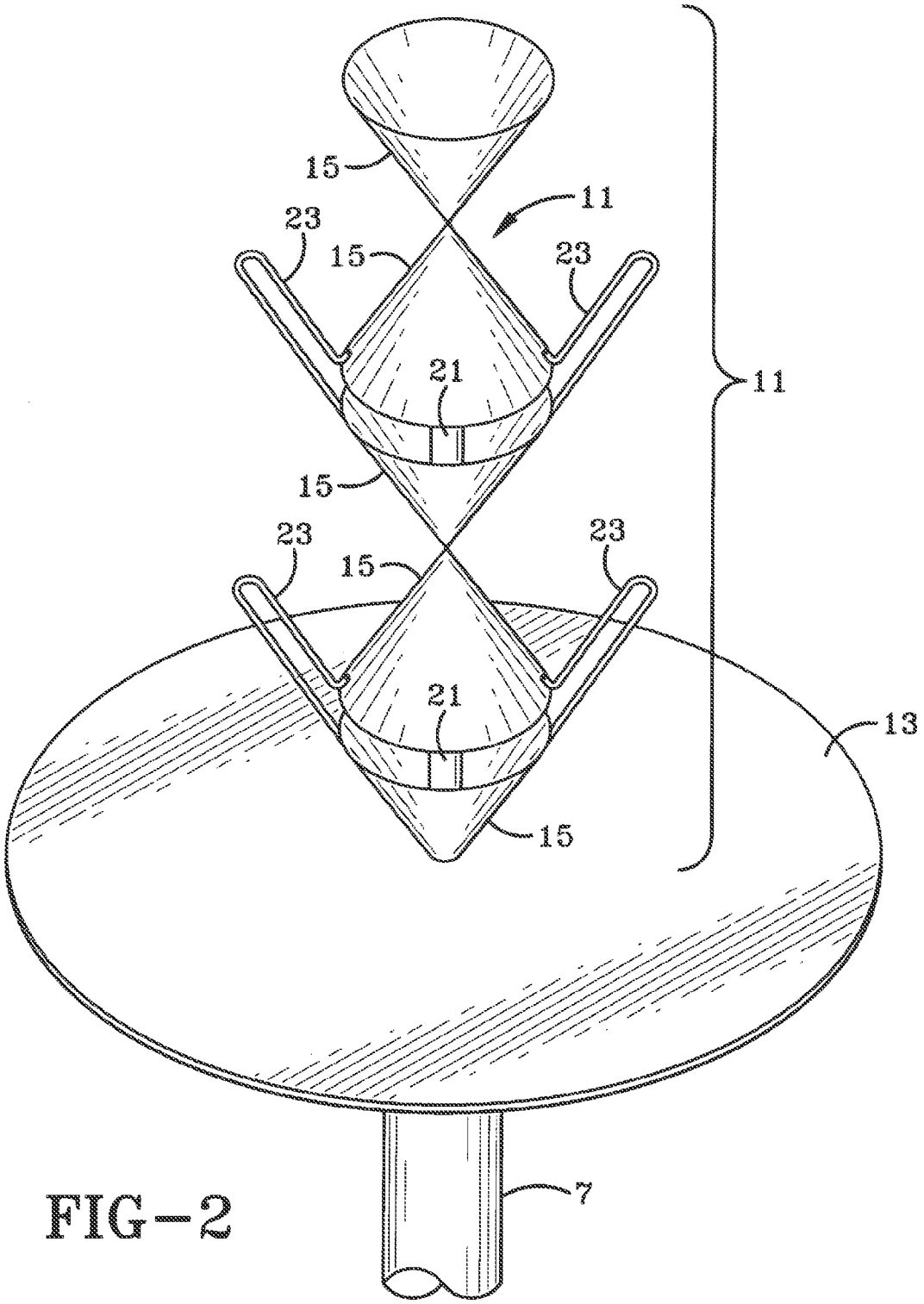
FIG. 2 is a perspective view of the antenna of the present invention.

The high gain wideband omnidirectional antenna of the present invention is shown in FIGS. 1-8 and is indicated generally at 1. As shown in FIG. 1, antenna 1 is typically formed as part of an overall antenna module 3 having antenna 1 encapsulated within a radome protective covering 5 to offer protection from weather elements. Antenna 1 is further typically connected to a mast 7 which may be hollow or solidified, depending on the desired configuration. As shown in FIG. 2, mast 7 may provide a structure for bringing a power cable 9 to antenna 1 to transmit power for energizing antenna 1. In the preferred embodiment, power cable 9 is a coaxial type of cable having a first power line 10 also referred to as the center lead and a second power line 12 also referred to as the shield, as shown in FIG. 3*a*. However, as commonly known in the art, power cable 9 may be of any type of power delivery cable, including twin lead with balun. Further, the present invention may include other structures as well or methods commonly known in the art for energizing antenna 1.

Figure 3A:
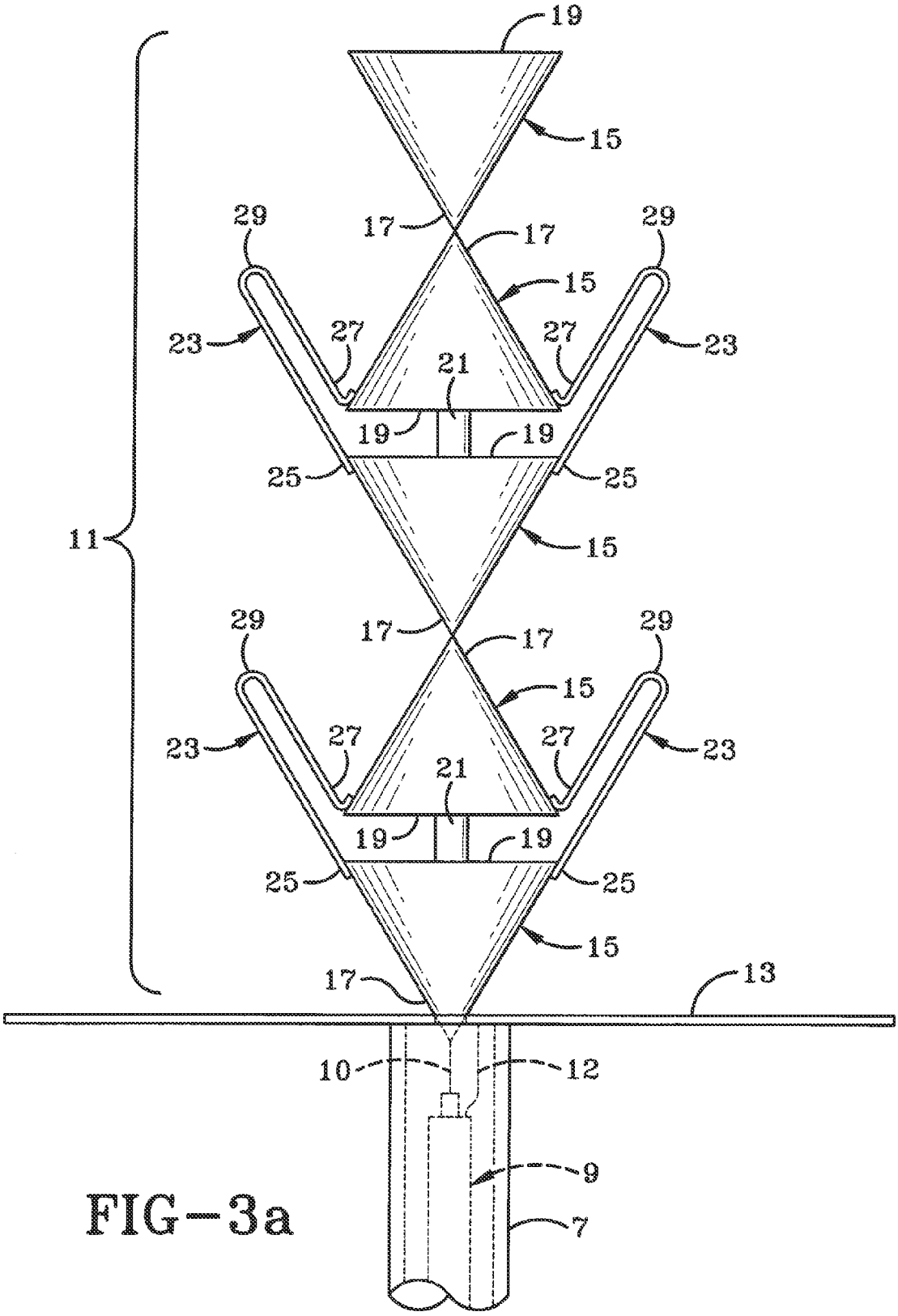
FIG. 3*a* is an elevational view thereof.

As shown in FIGS. 2 and 3*a*, antenna 1 is comprised primarily of a multi-coned section 11 energized by first power line 10 and a ground plane 13 energized by second power line 12. Coned section 11 is comprised of five cone elements, whereby each cone element 15 is formed in a conical shape and has a side length of approximately ¼ of the wavelength intended to be sent/received by antenna 1. Cone elements 15 are stacked consecutively, transposing the vertical position of an apex 17 of the particular cone element 15, with adjacent apexes 17 conductively connected to one another. Conversely, each cone element 15 further includes a base 19, which is separated from the next base 19 in the series by way of a non-conductive stabilizing beam 21. Stabilizing beams 21 separate one base 19 from the next base 19 and act to stabilize the overall coned section 11.

In the preferred embodiment, cone elements 15 are made from any conductive material, for example copper, and sized to have an overall side length of generally ¼ of the wave intended to be sent and/or received via antenna 1. As shown in FIG. 3*a*, the apex 17 of each cone element 15 is connected or secured to the apex 17 of an adjacent cone element 15. As such, this two cone element 15 structure is sized to have an operational resonant length of about ½ wave. As discussed previously, base 19 of each cone element 15 is not directly abuttably connected to the adjacent cone element 15. Base 19 of each cone element 15 is spaced apart from the adjacent cone element 15. However, inasmuch as the overall coned section 11 is energized in a series fed configuration, adjacent bases 19 are electrically connected via at least one phasing stub 23.

Figure 3B:
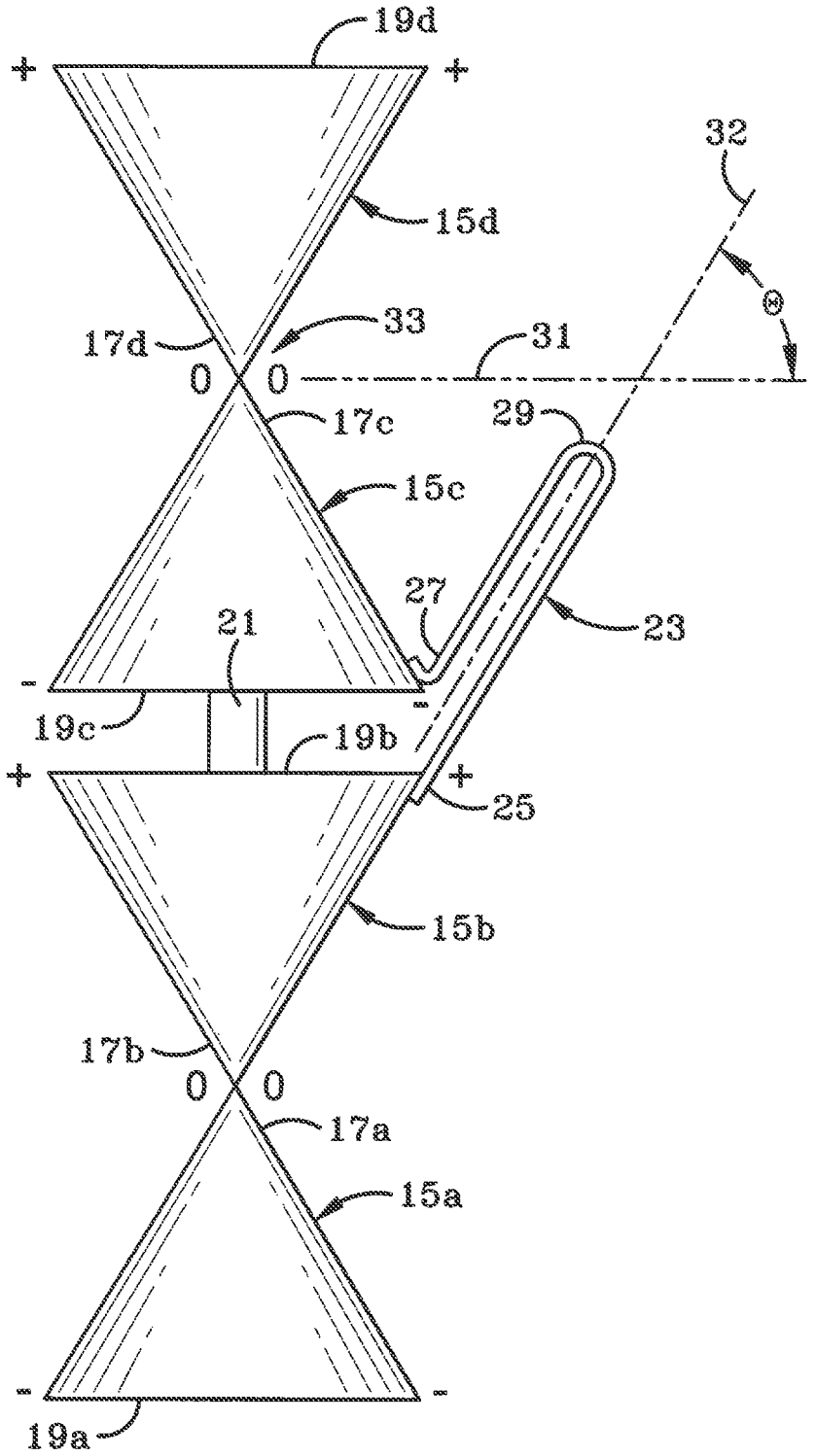
FIG. 3*b* is an elevational view of a section of the antenna of the present invention, showing two of the radiating elements.

As shown in FIGS. 3*a* and 3*b*, at least one phasing stub 23 extends from the base 19 of a cone element 15 to the adjacent base 19 of an adjacent cone element 15. This arrangement can be seen more particularly in FIG. 3*b*, where cone element 15*b* and adjacent cone element 15*c* are jointly supported with stabilizing beam 21 extending therebetween. Phasing stub 23 includes a first end 25 proximate base 19*b* of cone element 15*b* which extends to a second end 27 proximate base 19*c* of cone element 15*c*. As shown in FIG. 3*b*, with respect to the overall shape, phasing stub 23 extends from base 19*b* and first end 25 in an upwardly and outwardly extending direction to a phasing stub apex 29 and thereafter extends in a downwardly and inwardly extending direction to base 19*c* and second end 27. As shown in FIG. 3*b*, phasing stub 23 may extend such that phasing stub apex 29 is approximately co-planer with apex 17*c* of cone element 15*c* or at least generally proximate an imaginary horizontal plane 31.

Phasing stub 23 includes two important features. The first important feature relates to the overall length of phasing stub 23, and more particularly the distance between first end 25 and second end 27 with respect to the adjacent cone elements 15 in the series. Phasing stub 23 is configured such that the operating length is approximately one-half wavelength (λ). The length of phasing stub 23 ensures that the overall longitudinal wave cycle from the power cable 9 feed to the outer end of antenna 1 is similar for each two cone element 15 block. The length of phasing stub 23 therefore is configured to synchronize radiative phase between the cones it connects. Inasmuch as each two cone element 15 structure is sized to have an operational resonant length of about ½ wave and each phasing stub 23 connecting adjacent two cone element 15 structures is ½ wave, phasing stub 23 synchronizes the electromagnetic waves radiating from each two cone element 15 structure.

For example, as shown in FIG. 3*b* at a given moment $M_x$ the two cone element 15 comprised of cone element 15*a* connected to cone element 15*b* transitions from a negative wave amplitude at base 19*a*, to a neutral or zero wave amplitude at apexes 17*a* and 17*b*, and thereafter to a positive wave amplitude proximate base 19*b*. Inasmuch as base 19*b* and 19*c* are conductively separated by stabilizing beam 21 and the overall coned section 11 is a series fed antenna design, cone element 15*b* and cone element 15*c* must necessarily be conductively connected to continue the series. This is accomplished via phasing stub 23. To maintain longitudinal consistency with respect to wave amplitude, phasing stub 23 is provided with an operational length equal to one half wavelength (λ). As seen in FIG. 3*b*, a half wavelength phasing stub 23 allows the wave to conductively connect to the adjacent cone at the appropriate phase to maintain longitudinal consistency throughout coned section 11. In other terms, at a given moment $M_x$, whatever portion of the waveform base 19*a* is experiencing, phasing stub 23 ensures base 19*c* is experiencing the same portion of the waveform at the previous cycle of the wave. For example, at moment $M_x$, if the fraction of the wave cycle at base 19*a* of cone element 15*a* is a negative amplitude, the fraction of the wave cycle at base 19*c* of cone element 15*c* is also a similar negative amplitude.

The second important feature provided by phasing stub 23 is gain enhancement, particularly when compared to other phasing stub solutions which provide a parasitic effect and can diminish the overall gain of the antenna. Previous attempts at placing phasing stubs outside of the radiative elements of the antenna were failures due to the parasitic effect of the phasing stub on the electronic field radiated by the antenna. To that end, prior art phasing solutions were directed to making phasing elements more invisible with respect to the electronic field, by placing the phasing elements inside the radiating elements, as opposed to extending outwardly from the overall longitudinal axis of the antenna. These solutions were used to minimize the gain diminishing effects of the phasing elements. Conversely, rather than trying to minimize the parasitic effects of a phasing element, the present invention makes use of the phasing element to enhance the gain.

Phasing stub 23 is designed and positioned to generally continue the angle of the radiating cone element 15 immediately vertically below the particular phasing stub 23. As shown in FIG. 3*b*, one will readily recognize the angle of cone element 15*b* is continued by phasing stub 23 up to phasing stub apex 29, generally along an imaginary axis 32 of phasing stub 23 whereby imaginary axis 32 separates phasing stub 23 into two generally identical halves. Phasing stub 23 is preferably angled with respect to plane 31 such that there is approximately a 45° to 70° angle Θ between plane 31 and axis 32 of phasing stub 23, with the ideal angle being generally where Θ is equal to 60°. Positioning a radiating element near another radiating element may result in significant disruption to the gain and overall radiation pattern. However, it has been discovered that by orienting phasing stub 23 at approximately a 60° angle and aligning phasing stub 23 generally to continue the surface of cone element 15*b* towards phasing stub apex 29, the gain of antenna 1 is not diminished nor is the pattern disrupted. Conversely, the gain is enhanced due to phasing stub 23 and the open nature of this radiating element with respect to cone element 15*b*. A phasing stub with axis 32 parallel to plane 31 acts to "box" the signal in between the phasing stub and the lower cone element with the phasing stub as an upper bound on the signal. Conversely, the orientation of phasing stub 23 of the present invention acts to enhance the interaction between base upward cones, with base downward cones and ground plane 13. This represents an enormous leap in the art, as phasing solutions of previous embodiments necessarily affected the radiation pattern in a gain diminishing way.

Figure 3C:
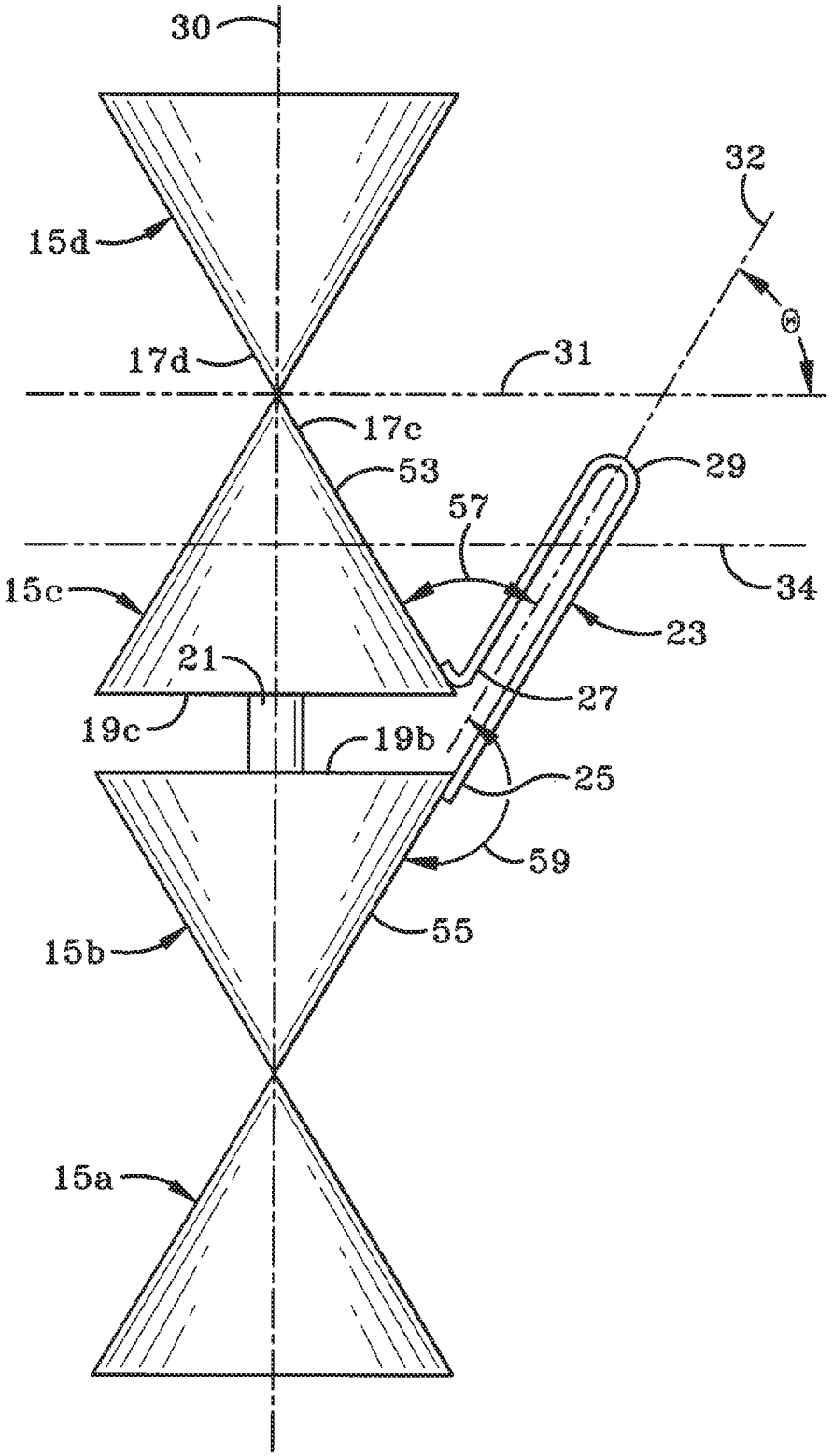
FIG. 3*c* is an elevational view of a second of the antenna of the present invention, showing two of the radiating elements.

As shown in FIG. 3*c*, there exists an imaginary longitudinal center axis 30 extending through the axial center of antenna 1. Further, there exists an imaginary middle plane 34 which extends horizontally through the longitudinal middle of cone element 15*c*. The longitudinal middle is defined as the general midpoint between apex 17*c* and base 19*c*. It is one of the primary features of the present invention that phasing stub apex 29 is disposed vertically above imaginary middle plane 34, as shown in FIG. 3*c*. Further, phasing stub apex 29 is disposed vertically below imaginary plane 31, which extends through apex 17*c* of cone element 15*c*. Cone element 15*c* includes an outer surface 53 and cone element 15*b* includes an outer surface 55. To further describe the preferred orientation of phasing stub 23, outer surface 53 in the area most proximate phasing stub 23 extends at an acute angle with respect to axis 32. Further, outer surface 55 in the area most proximate phasing stub 23 extends at an obtuse angle with respect to axis 32. As shown in FIG. 3*c*, one will recognize that phasing stub apex 29 is disposed between a midpoint of phasing stub 23 and second end 27 of phasing stub 23 and is not symmetrically disposed at the midpoint between first end 25 and second end 27 due to the angled and non-symmetrical nature of phasing stub 23.

Antenna 1 preferably includes three ½ wave radiating components, with the lower of those three components incorporating ground plane 13 in place of an apex-upward cone. For some background, typical ground planes used in the art may be oriented perpendicular to the axis of the antenna element and disposed generally horizontally parallel with the horizon. Other standard ground planes may angle downwardly such as a straight 30°, 45°, or 60° angle down with respect to the horizon. Further, standard ground planes generally are constructed with a radius of ¼ wave length. Ground plane 13 operates generally in the manner expected by those familiar with the art and is oriented generally horizontally parallel with the horizon. However, in addition to the expected and commonly known benefits of ground plane 13, it has been discovered that by making ground plane 13 comparatively substantial more continuous and of greater dimension there is increase in the overall bandwidth and gain of antenna 1.

Figure 7:
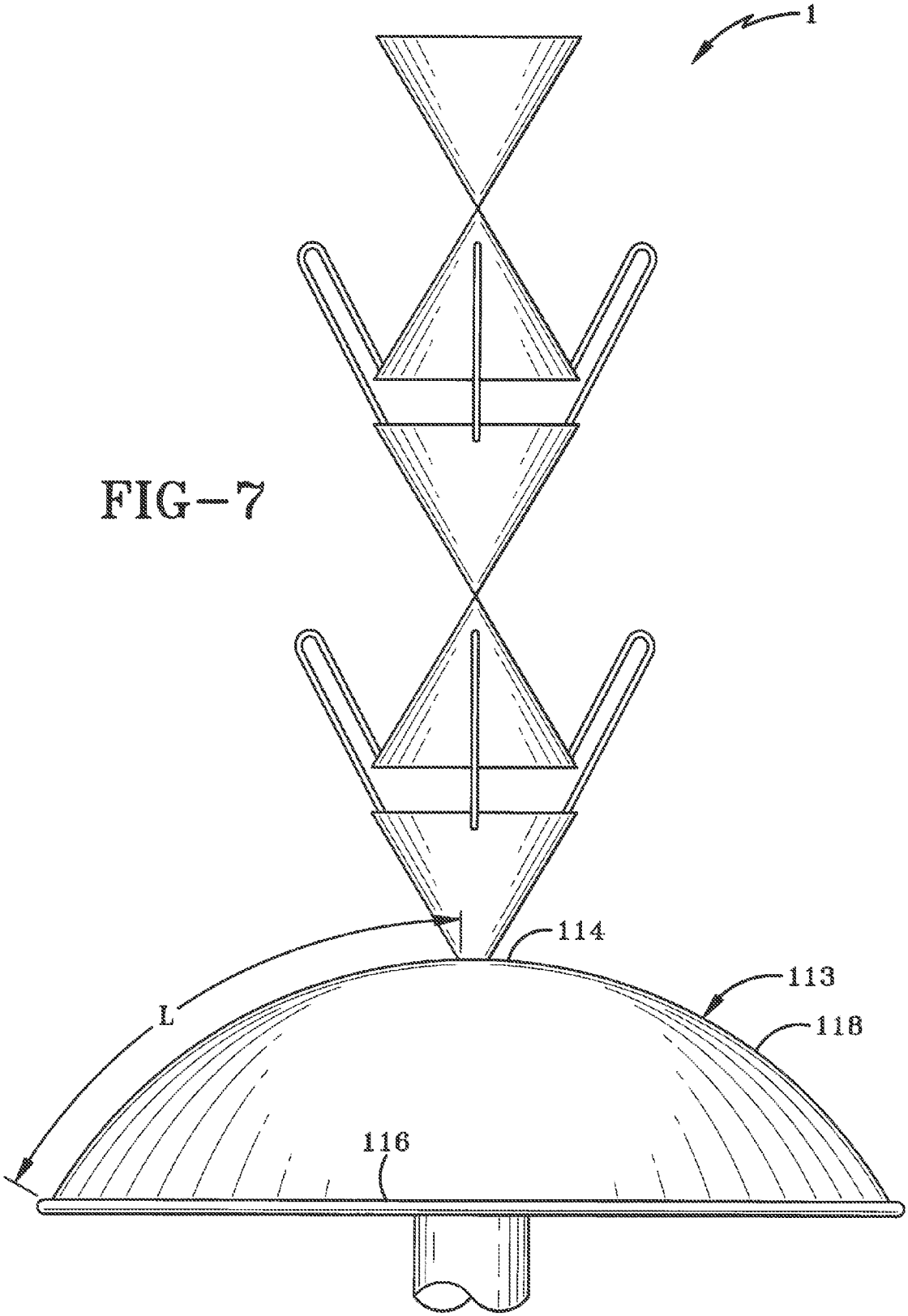
FIG. 7 is an elevational view of an antenna of the present invention incorporating a dome shaped ground plane.
Figure 8:
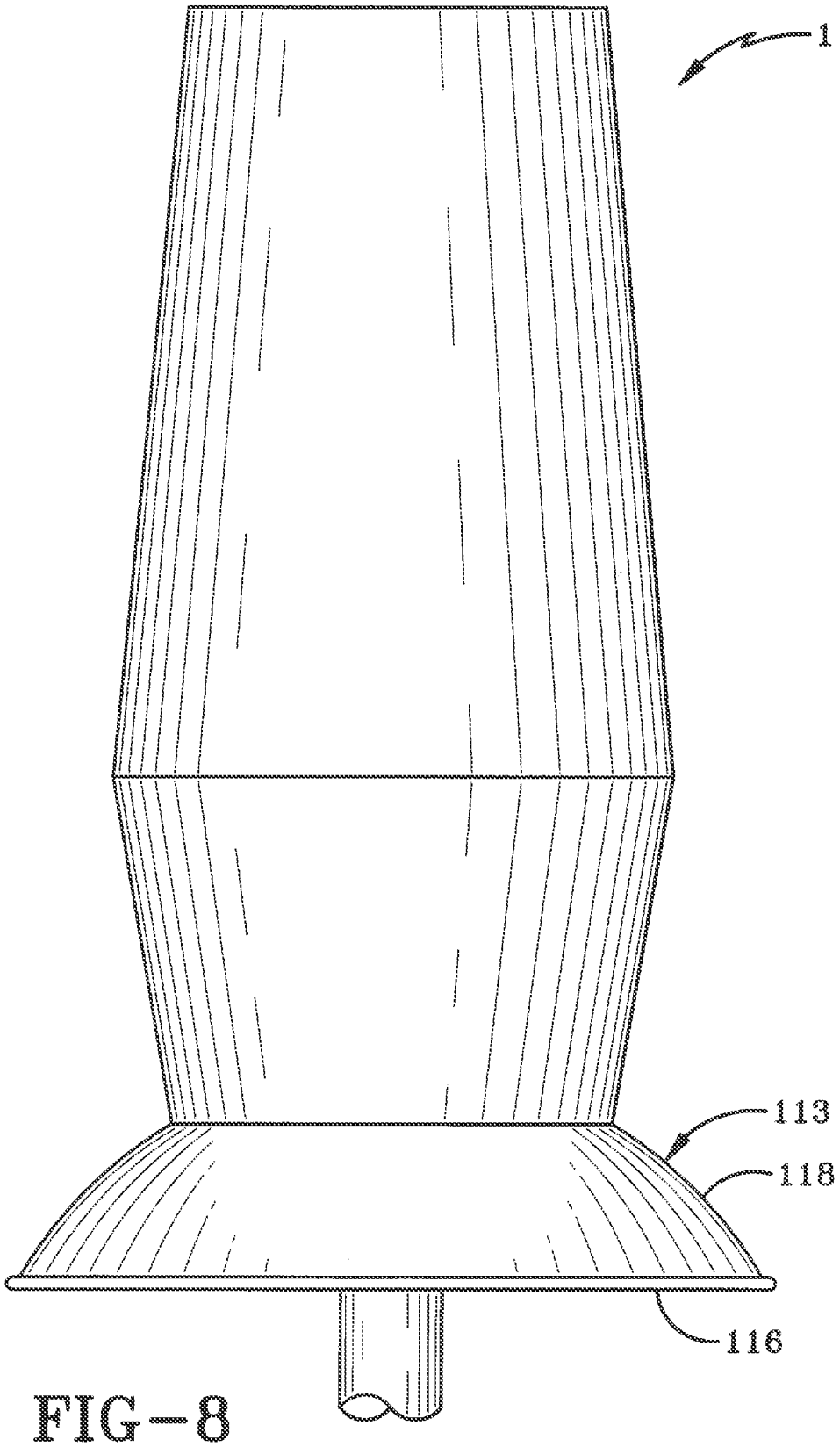
FIG. 8 is an elevational view of an antenna of the present invention similar to FIG. 6 and having a radome cover disposed thereon.

As shown in FIGS. 7 and 8, a ground plane 113 may be provided on antenna 1. Ground plane 113 is formed in a dome shape that generally resembles the hollow upper third of a sphere, having an apex 114 disposed vertically above a continuous rim 116. Ground plane 113 includes an arcuate outer surface 118 which is generally flat and smooth, although multiple curvilinear wires could be utilized, and formed in a curved or arcuate shape extending from apex 114 to rim 116. While typical ground planes are constructed with a center-to-edge length of ¼ wave length, it has been discovered that by forming ground plane 113 with an arcuate apex-to-rim length L generally equal to ½ wave length or greater, several beneficial effects are realized. These include a greater frequency bandwidth, particularly with respect to standing wave ratio and performance. The benefits further include an improved signal pattern and overall gain, as the dome shape of ground plane 113 couples and resonates with cone elements 15 and potentially with portions of phasing stubs 23, as described above. In summary, through extensive experimentation, it has been discovered that by forming ground plane 113 in a general dome shape and setting the arcuate apex-to-rim length of L generally equal to ½ wave length, enormous benefits have been achieved over a standard ground plane.

Figure 4:
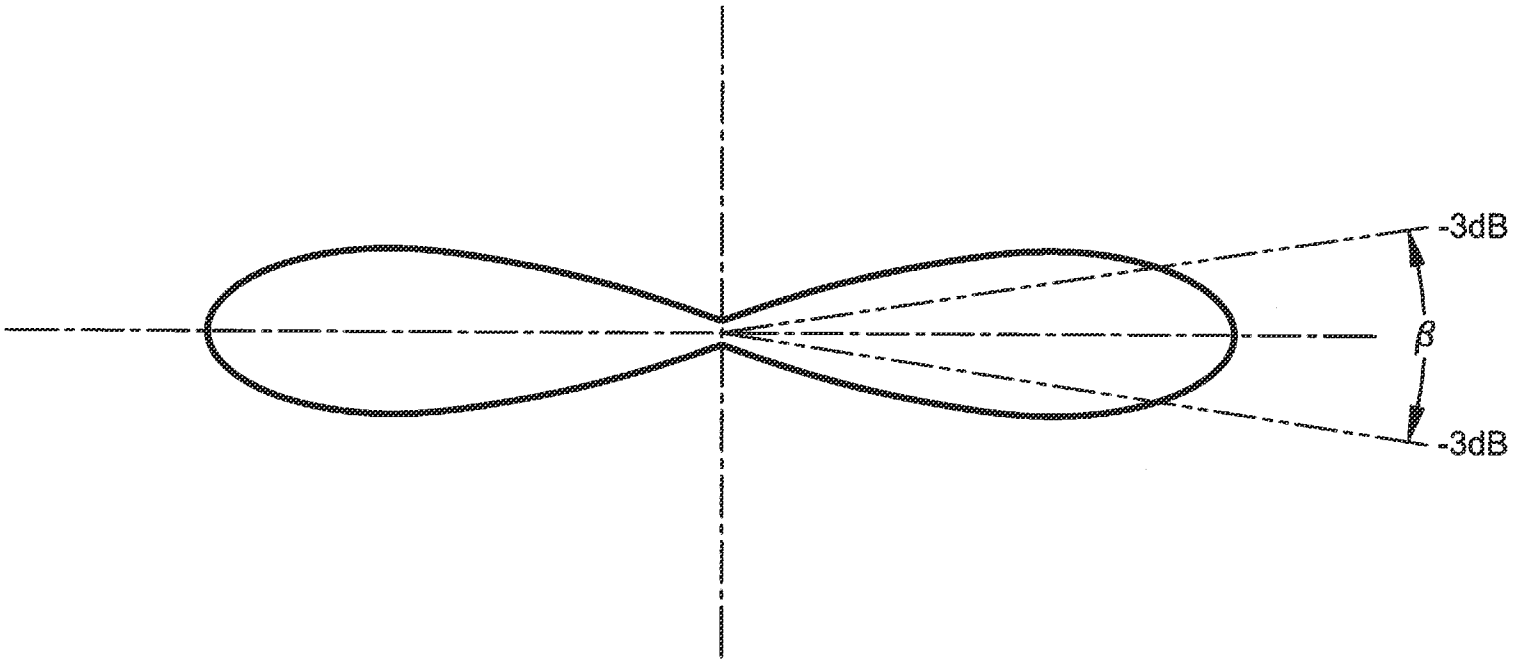
FIG. 4 is a representational elevational coordinate signal pattern radiated by the present invention.

FIG. 4 shows a sample elevation coordinate signal pattern for antenna 1. The signal pattern provided by antenna 1 portrays the merging of signal patterns provided by antenna 1 by way of reducing undesirable lobes while producing a broad and strong elevation signal pattern at, above, and below the horizon. The signal pattern also reduces signal overshoot problems seen with other designs where a radiated signal may pass over the desired target receiving unit. As shown in FIG. 4, antenna 1 resonates a high gain wideband omnidirectional signal which may be in the range of 3 dB above and below the horizontal and resonated at an angle generally of β.

Figure 5:
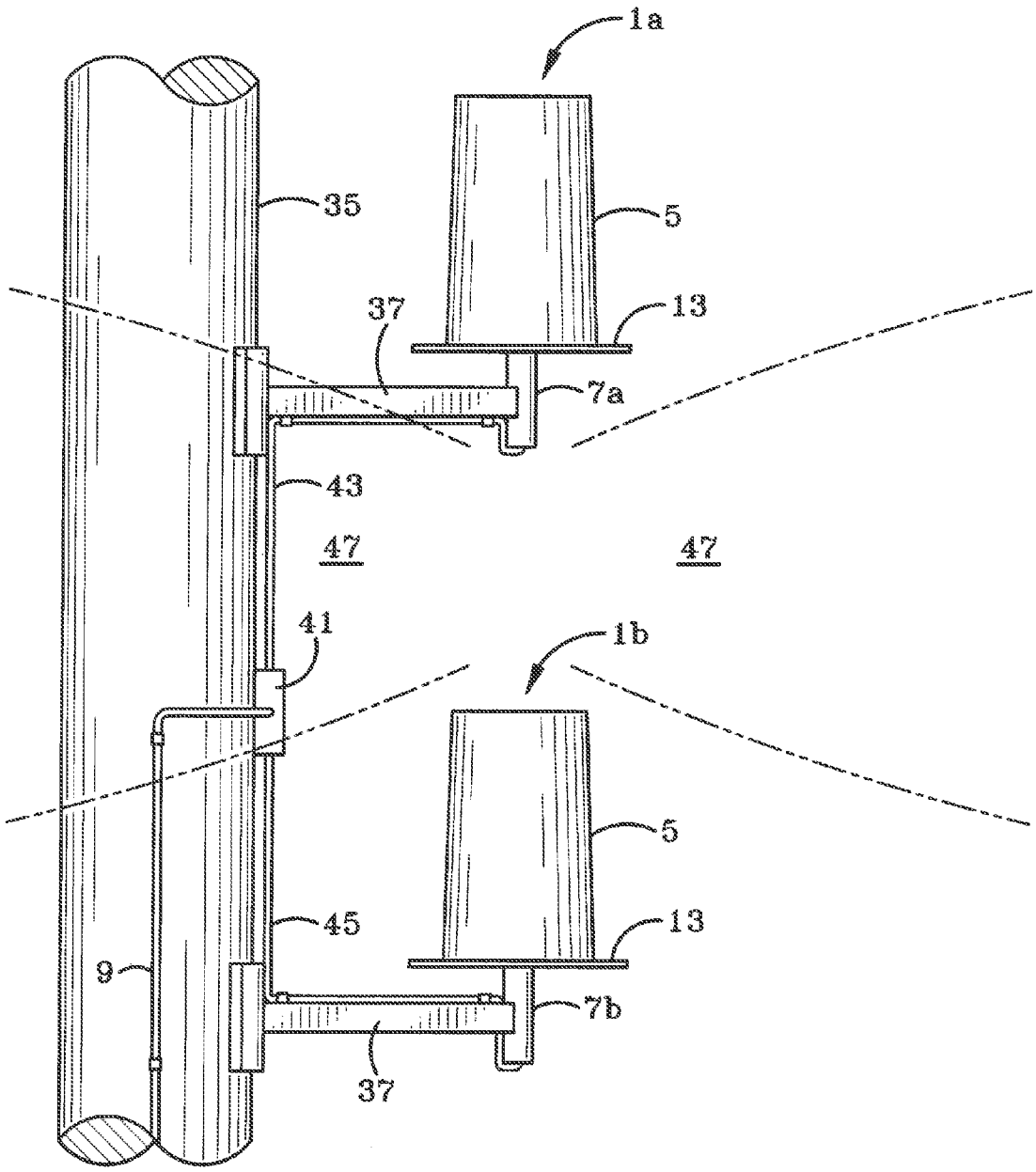
FIG. 5 is an elevational view of a pair of antennas of the present invention extending from a mast.

As shown in FIG. 5, the series-fed collinear high gain omnidirectional antenna 1 of the present invention may be stacked with multiple antennas 1 to increase the gain. As shown in FIG. 5, antenna 1*a* is stacked vertically coaxially with antenna 1*b*. Antenna 1*b* includes mast 7*a* connected to a first horizontal arm extending from a tower 35. Similarly, antenna 1*b* includes a mast 7*b* connected to a second vertical arm 39 extending from tower 35. First horizontal arm and second horizontal arm are generally similar length in order to position antenna 1*a* directly vertically above antenna 1*b* in a generally coaxial alignment. As shown in FIG. 5, power line 9 extends along tower 35 and into a power divider 41 whereby power cable 9 is divided and split into equal lengths first power line 43 and second power line 45. First power line 43 energizes and provides power to antenna 1*a* while second power line 45 energizes and provides power to antenna 7*b*. The configuration represented in FIG. 5 is exemplary and may further include additional antennas 1 disposed about tower 35. A signal pattern 47 produced by antenna 1 in FIG. 5 is shown in phantom and is representational of the signal pattern produced by the present invention in the configuration of FIG. 5.

Figure 6:
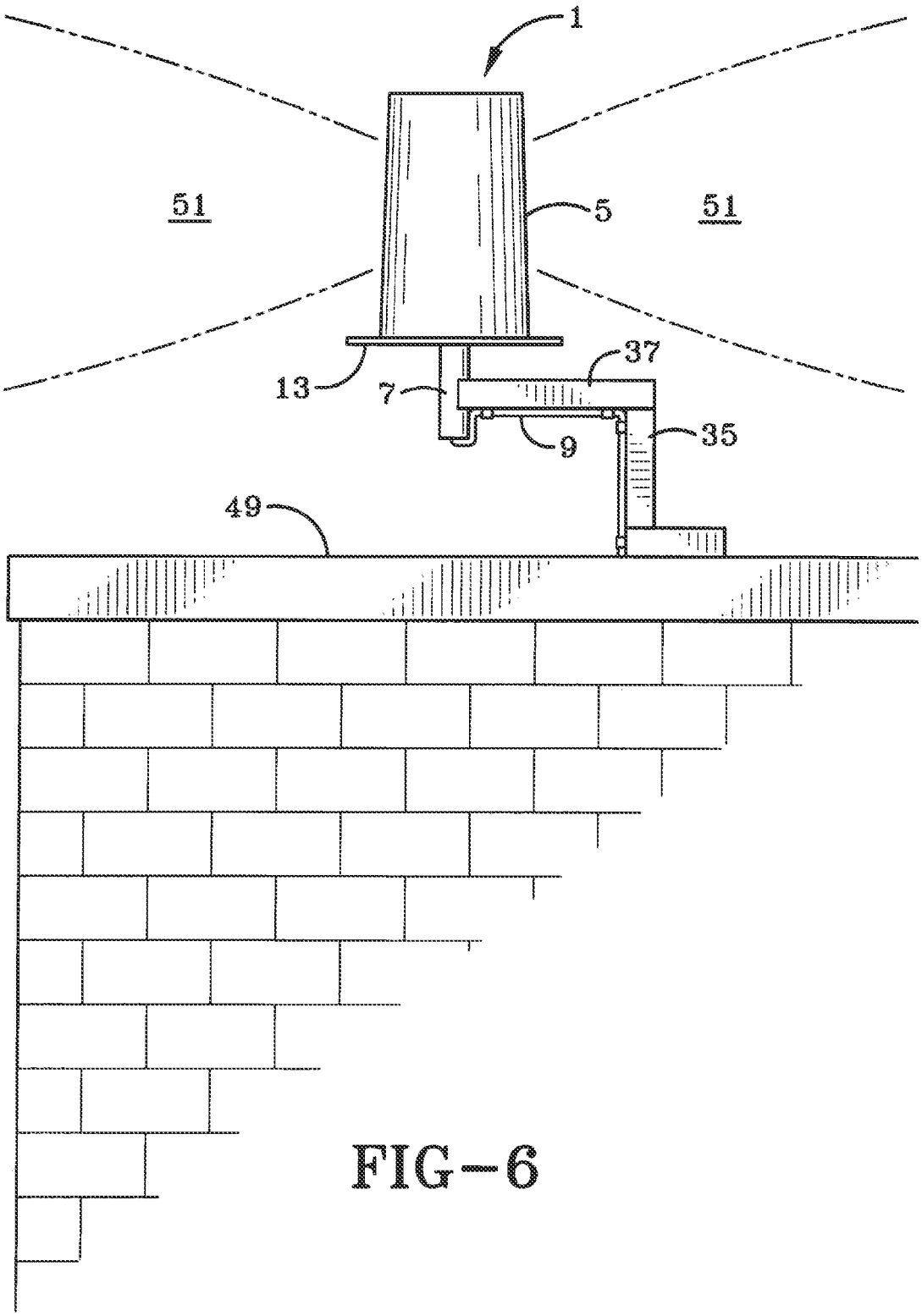
FIG. 6 is an elevational view of an antenna of the present invention extending from a building.

As shown in FIG. 6, antenna 1 may be used singularly as desired and as appropriate for particular applications, for example on a building 49. The embodiment shown in FIG. 6 includes antenna 1 connected to mast 7 which is in turn connected to first horizontal arm 37. First horizontal arm 37 extends outwardly from tower/mast 35 which is much smaller and more compact to take advantage of the overall height of building 49. Power cable 9 extends from building 49 up tower 35 and into antenna 1 as described in previous embodiments. A signal pattern 51 produced by antenna 1 in FIG. 6 is shown in phantom and is representational of the signal pattern produced by the present invention in the configuration of FIG. 6. Signal pattern 51 is broader and less far-reaching than signal pattern 47.

In other embodiments ground plane 13 may be for example the sheet metal of a roof of a building or of a vehicle, and may be even larger with similar benefits.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A series-fed collinear high gain omnidirectional antenna adapted to radiate electromagnetic energy at an intended frequency having a wave length, the antenna comprising:

a first radiative element comprised of a first cone having a first apex and a second cone having a second apex, wherein the first apex is secured to the second apex;

a second radiative element comprised of a third cone having a third apex; and a first phasing stub extending outwardly away from the second cone to a first phasing stub apex and extending inwardly from the first phasing stub apex towards the third cone, wherein the first phasing stub includes a first length configured to synchronize radiative phase between the first radiative element and the second radiative element.

2. The series-fed collinear high gain omnidirectional antenna of claim 1, further comprising:

an imaginary longitudinal central axis extending through first apex, second apex, and third apex;

an imaginary plane extending orthogonal to the imaginary longitudinal central axis and through the second apex; and wherein the first phasing stub apex is proximate the imaginary plane.

3. The series-fed collinear high gain omnidirectional antenna of claim 2, further comprising:

a dome shaped ground plane having a ground plane apex; and wherein the third apex is secured to the ground plane apex.

4. The series-fed collinear high gain omnidirectional antenna of claim 3, further comprising:

a coaxial cable for feeding power to the antenna;

wherein the coaxial cable includes a first power line connected to the third cone and a second power line connected to the ground plane;

wherein the first power line energizes the third cone and the first radiative element; and wherein the second power line energizes the ground plane.

5. The series-fed collinear high gain omnidirectional antenna of claim 4, wherein the first cone, second cone, and third cone include a side length of at least ¼ of the wavelength of the intended frequency.

6. The series-fed collinear high gain omnidirectional antenna of claim 5, wherein the first length is at least ½ of the wavelength of the intended frequency.

7. The series-fed collinear high gain omnidirectional antenna of claim 6, further comprising a ground plane rim spaced at least ½ of the wave length of the intended frequency from the ground plane apex.

8. A series fed collinear antenna comprising:

a first cone shaped element having a first apex and a first base and adapted to radiate electromagnetic energy;

a second cone shaped element having a second apex and a second base and adapted to radiate electromagnetic energy;

a phasing stub having a length and extending outwardly away from the first cone shaped element and the second cone shaped element;

wherein the phasing stub electrically connects the first cone shaped element and the second cone shaped element; and wherein the length is configured synchronize radiative phase between the first cone shaped element and the second cone shaped element.

9. The series fed collinear antenna of claim 8, wherein the first base and the second base are proximate.

10. The series fed collinear antenna of claim 9, wherein the phasing stub extends outwardly from the first cone shaped element to a phasing stub apex, and wherein the phasing stub extends inwardly from the phasing stub apex to the second cone shaped element.

11. The series fed collinear antenna of claim 10, further comprising an imaginary central axis extending through the first apex and the second apex;

an imaginary first plane extending orthogonally through the central axis and through the first apex;

an imaginary second plane extending orthogonally through the central axis and through the first base; and wherein the phasing stub apex is disposed between the imaginary first plane and the imaginary second plane.

12. The series fed collinear antenna of claim 10, further comprising an imaginary middle plane extending orthogonally through the central axis and through a midpoint between the first apex and the first base; and wherein the phasing stub apex is disposed between the imaginary first plane and the imaginary middle plane.

13. The series fed collinear antenna of claim 10, further comprising a dome shaped ground plane having a ground plane apex, a ground plane rim, and an arcuate length extending therebetween.

14. The series fed collinear antenna of claim 13, wherein the series fed collinear antenna is adapted to radiate electromagnetic energy at an intended frequency, and wherein the arcuate length is at least ½ of a wave length of the intended frequency.

15. The series fed collinear antenna of claim 10, further comprising a stabilizing beam extending between the first cone shaped element and the second cone shaped element.

16. An antenna comprising:

a first element having a first end and a spaced apart second end and adapted to radiate electromagnetic energy;

a second element having a third end and a spaced apart fourth end and adapted to radiate electromagnetic energy;

at least one phasing stub having a phasing stub length and extending outwardly away from the first element to a phasing stub apex and extending inwardly to the second element from the phasing stub apex;

a transmitter for supplying electrical power to one of the first element and the second element;

wherein the at least one phasing stub electrically connects the first element and the second element in series; and wherein the phasing stub length is configured to synchronize radiative phase between the first element and the second element.

17. The antenna of claim 16, wherein the second end and the third end are proximate, and wherein the stabilizing beam extends between the first element and the second element.

18. The antenna of claim 16, further comprising:

a dome shaped ground plane having a ground plane apex, a ground plane rim, and an arcuate length extending therebetween;

wherein the antenna is adapted to radiate electromagnetic energy at an intended frequency; and wherein the arcuate length is at least ½ of a wave length of the intended frequency.

19. The antenna of claim 18, wherein the phasing stub length is at least ½ of a wavelength of the intended frequency.

20. The antenna of claim 16, further comprising:

a first end of the at least one phasing stub, wherein the first end is secured to the first element;

a second end of the at least one phasing stub, wherein the second end is spaced apart from the first end and secured to the second element;

a midpoint of the at least one phasing stub, wherein the midpoint is generally equidistant between the first end and the second end; and wherein the phasing stub apex is located between the first end and the midpoint.

* * * * *